United States Patent [19]

Chapman, Jr. et al.

[11] 4,403,428

[45] Sep. 13, 1983

[54] SUCTION DREDGE CUTTER HEAD

[76] Inventors: Marion R. Chapman, Jr., General Delivery, Gloucester, Va. 23061; Marion J. Chapman, 1102D Holik, College Station, Tex. 77840

[21] Appl. No.: 321,238

[22] Filed: Nov. 13, 1981

[51] Int. Cl.[3] ..... E02F 3/92

[52] U.S. Cl. ..... 37/57; 37/67; 241/84

[58] Field of Search ..... 37/67, 65, 64, 57; 241/46.11, 84, 83, 95, 46.06, 46 R

[56] References Cited

U.S. PATENT DOCUMENTS

| | | | |
|---|---|---|---|
| 1,087,269 | 2/1914 | Baltz | 37/67 |
| 1,713,037 | 5/1929 | Ellis | 37/65 |
| 2,530,951 | 11/1950 | Enright | 37/67 |
| 2,619,292 | 11/1952 | Nichols, Jr. et al. | 241/84 X |
| 3,375,983 | 4/1968 | Von Eiff et al. | 241/46.11 |
| 3,808,716 | 5/1974 | Verbeek | 37/67 |
| 3,945,576 | 3/1976 | Kahmann | 241/84 X |
| 4,050,170 | 9/1977 | Proehl | 37/67 |
| 4,365,427 | 12/1982 | Chapman, Jr. | 37/57 |

FOREIGN PATENT DOCUMENTS

| | | | |
|---|---|---|---|
| 233271 | 5/1925 | United Kingdom | 37/67 |
| 238422 | 7/1969 | U.S.S.R. | 37/67 |
| 422826 | 9/1974 | U.S.S.R. | 37/67 |
| 601418 | 4/1978 | U.S.S.R. | 37/67 |
| 612031 | 6/1978 | U.S.S.R. | 37/67 |

*Primary Examiner*—Clifford D. Crowder

*Attorney, Agent, or Firm*—Cushman, Darby & Cushman

[57] ABSTRACT

The rotatable cutter head of a suction dredge which is of rearwardly-divergent spiral toothed-rib construction has a crusher of open-work construction fixedly mounted therewithin and cooperating therewith to crush and reduce the size of hard lumps dug by the head to reduce damage to and clogging of the suction and discharge lines and the dredge pump. Preferably, the crusher is a frusto-conical grid having a flat sector which further cooperates with inner surface portions on the cutter head ribs that incline inwardly from the leading to the trailing edges of such portions.

8 Claims, 5 Drawing Figures

SUCTION DREDGE CUTTER HEAD

FIELD OF THE INVENTION

This invention relates to dredges and, more particularly, to improvements in the cutter heads of suction dredges for crushing solids to minimize clogging of and damage to suction and discharge pipes and dredge pumps. This invention especially relates to an improvement or modification of the cutter head invention disclosed in the copending application of Marion R. Chapman, Jr. Ser. No. 285,527, filed July 21, 1981, now U.S. Pat. No. 4,365,427.

BACKGROUND OF THE INVENTION

Suction dredges normally have a downwardly and forwardly inclined ladder carrying a suction pipe which has a suction mouth at its forward end and a rotatable cutter head just forward of such mouth. The head normally is driven by a shaft extending along the ladder from a motor on the upper end of the shaft. Usually the cutter head has a plurality of angularly spaced, toothed ribs spiralling divergently rearwardly from a hub at the forward end of the drive shaft. When sand or muck is being dredged, no problems normally arise. When the cutter head is working in hard lumpy clay, sandstone, coral, or other fossil or rock formations, however, problems are encountered in the production of large hard lumps that pass through the cutter head and are large enough to clog or damage the suction and discharge lines and the dredge pump. Clogging or stopping of the lines necessitates time-consuming down-time clean-out operations. Pump damage necessitates expensive down-time replacement or repair.

The foregoing problems were solved by the invention disclosed in my aforesaid copending patent application by the provision of an open-work rotatable crusher journalled on the cutter head drive shaft and driven by a gear train between the cutter head and the crusher. Such a solution, however, while most effective, is somewhat complicated and expensive because the crusher is mounted for rotation and requires a gear drive.

BRIEF SUMMARY OF THE INVENTION

Accordingly, it is an object of this invention to incorporate in the cutting head of a suction dredge simple, inexpensive, non-rotatable, efficient means for crushing large hard lumps of material dug by the head before they enter the suction pipe in order to minimize or prevent clogging of and/or damage to the suction and discharge lines and the dredge pump.

It is another object of this invention to provide such crushing means in the form of a crusher that can be easily installed within a conventional cutter head with few modifications thereto.

The foregoing objects are accomplished by an open-work crusher fixed to the ladder within the rotatable cutter head and arranged to cooperate with the head so that rotation of the latter crushes large lumps of material dug by the head to a smaller size before entry into the suction pipe.

Other objects and advantages of the invention will become apparent from the following detailed description and accompanying drawings, in which:

DETAILED DESCRIPTION OF THE INVENTION

Figure 1:
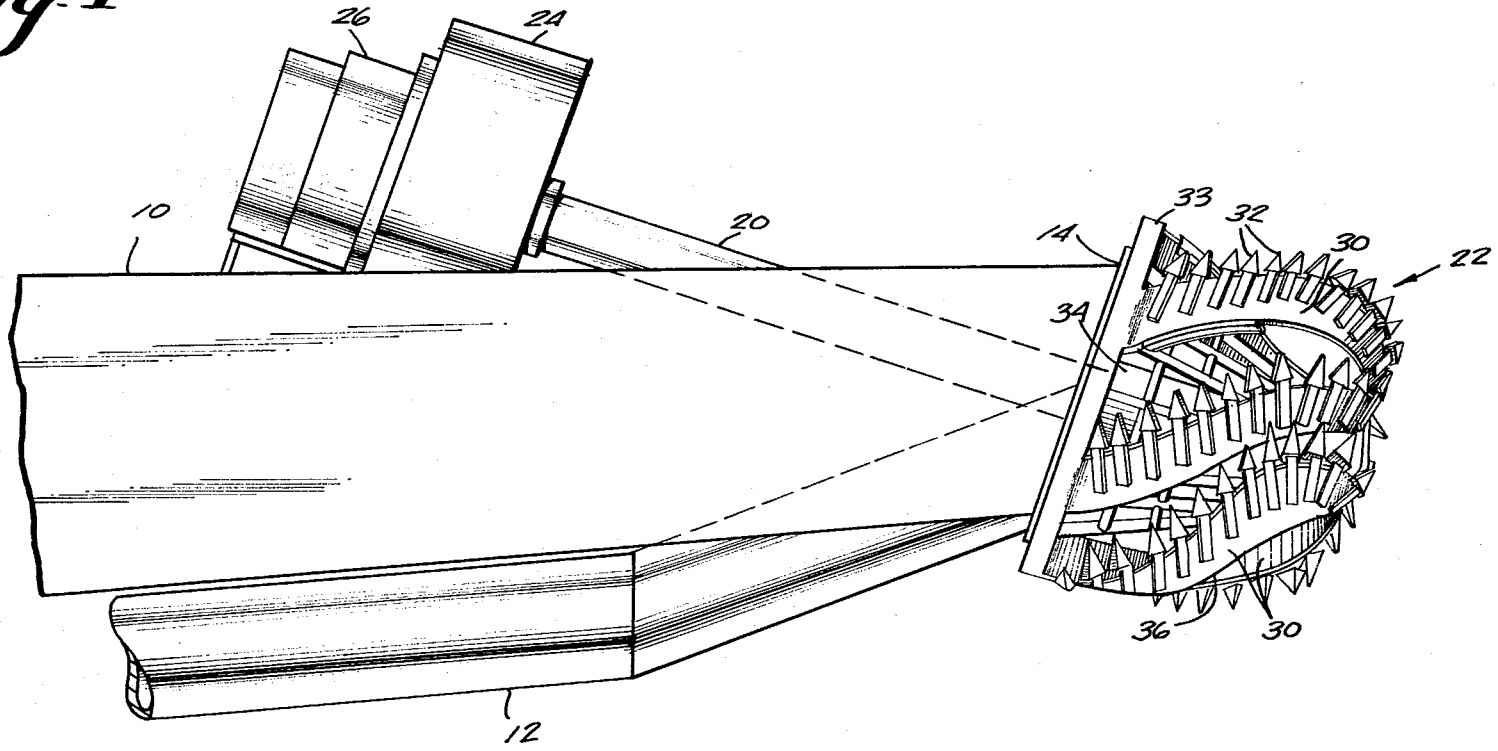
FIG. 1 is a side elevation of a suction dredge ladder equipped with a cutter head embodying this invention.
Figure 2:
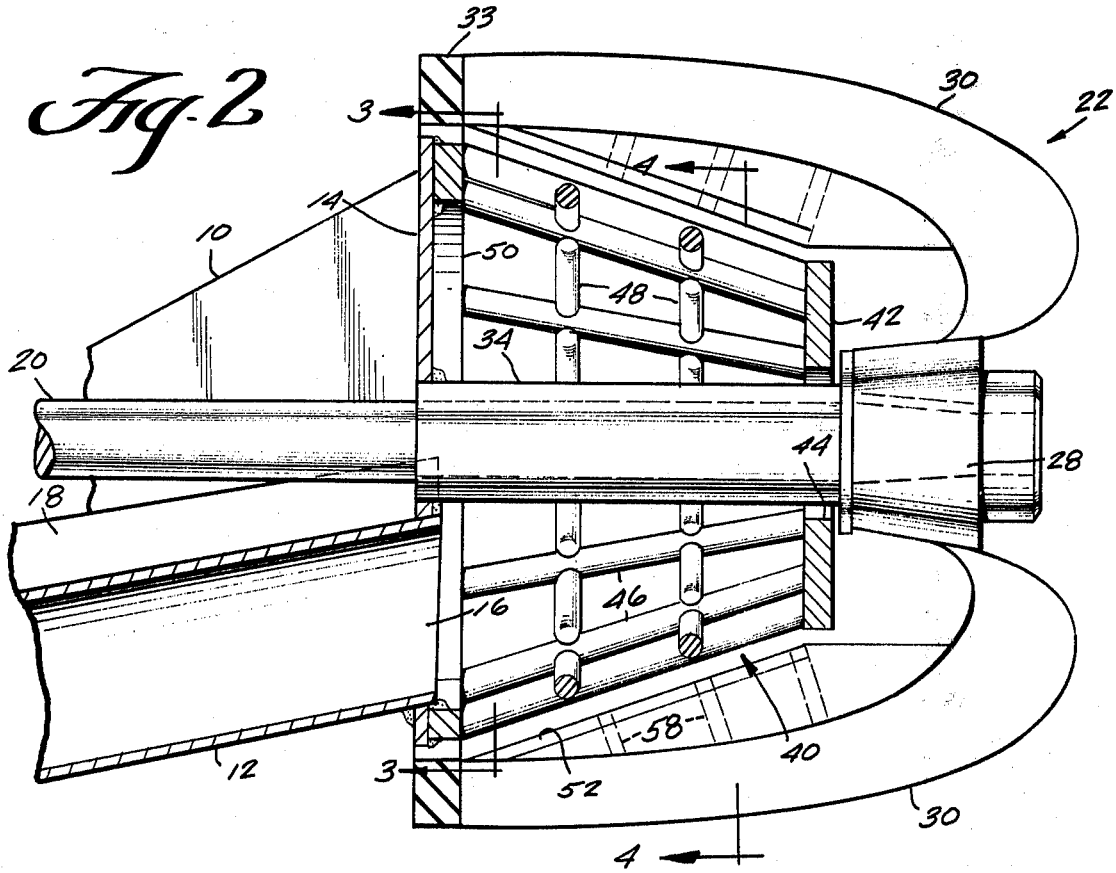
FIG. 2 is an enlarged fragmentary longitudinal sectional view of the cutter head shown in FIG. 1, the head being shown somewhat schematically in FIG. 1.
Figure 4:
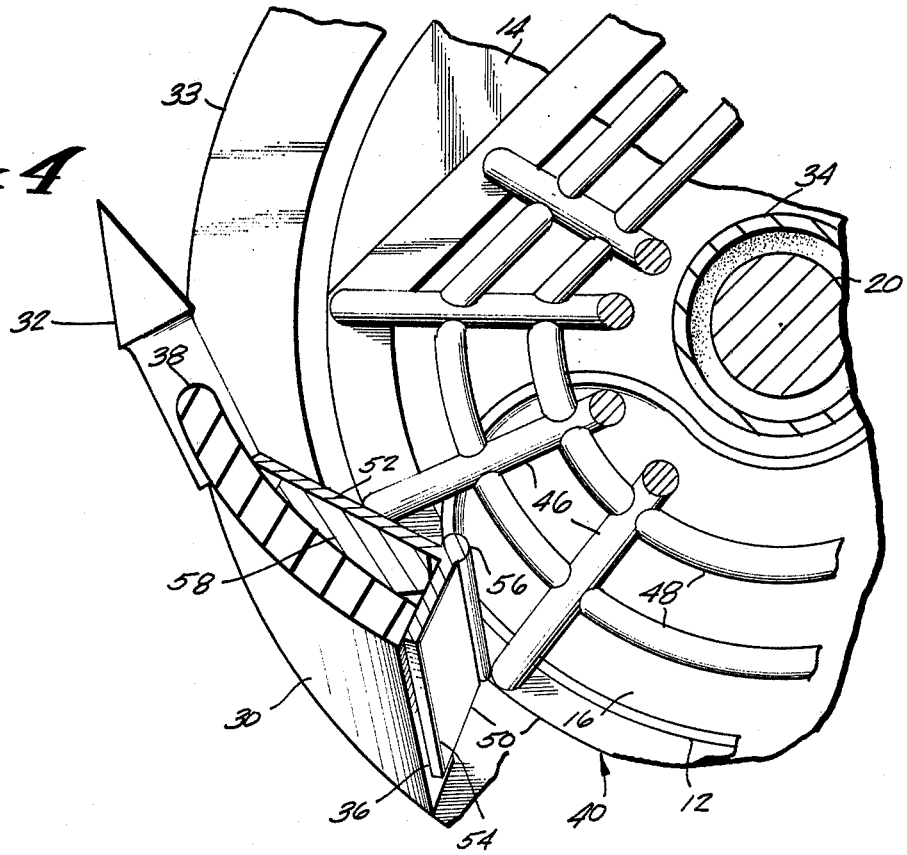
FIG. 4 is an enlarged fragmentary sectional view taken substantially on line 4—4 of FIG. 2.
Figure 5:
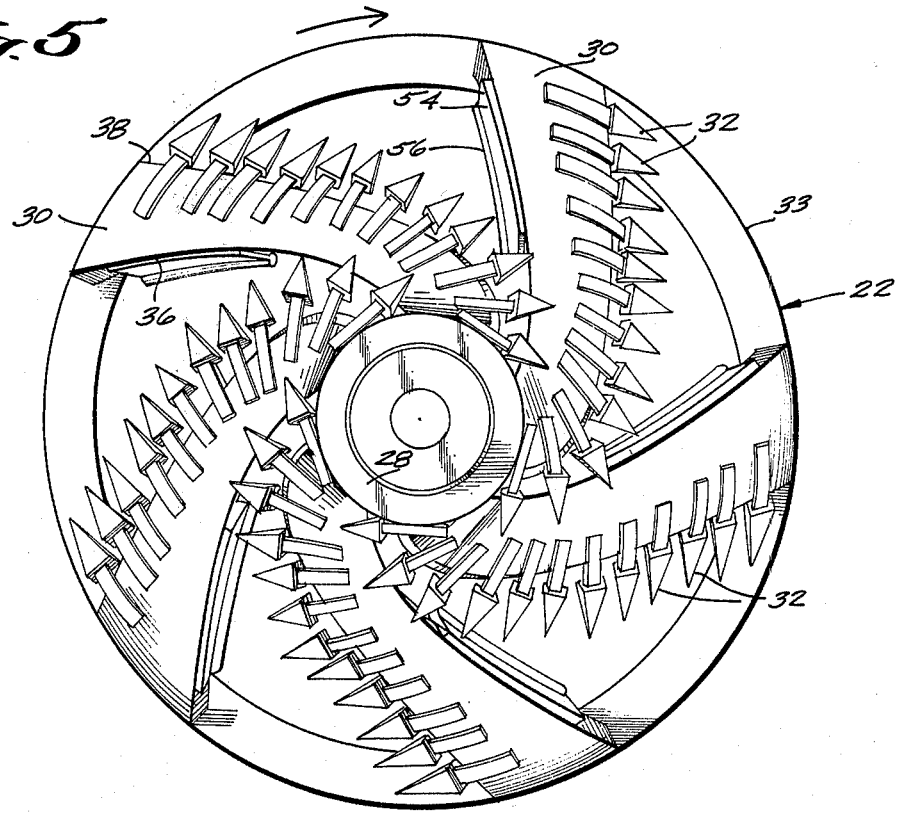
FIG. 5 is an end view of the cutter head shown in FIG. 1.

Referring now to the drawings, there is shown diagrammatically the usual suction dredge ladder 10 which carries on its underside the usual suction pipe 12 leading to a dredge pump (not shown). The forward end of the ladder 10 carries a downwardly and rearwardly inclined circular flat plate 14 pierced by the semi-circular suction mouth 16 of the suction pipe 12. Adjacent the mouth 16, the pipe 12 is channeled, as at 18, along its upper side for accommodation of a drive shaft 20 extending through the plate 14, for a cutter head 22. The shaft 20 is driven through appropriate reduction gearing 24 by an appropriate motor 26 which may be mounted on the ladder 10, as shown, or on the dredge hull, not shown. The forward end of the shaft 20 is journalled in a bearing (not shown) supported on the ladder 10 and projects beyond the suction mouth 16. Secured on the end of the shaft 20 is the hub 28 of the cutter head 22 from which spiral divergently rearwardly a plurality of angularly spaced somewhat flattened ribs 30 equipped on their forward edges with projecting teeth 32. At their rearward end, the ribs 30 are secured to a ring member 33 which surrounds the plate 14. For reasons later evident, that section of the shaft 20 extending between the plate 14 and the hub 28 preferably is enclosed in a protective sleeve 34 secured to the plate 14. The head 22 may be driven in a clockwise direction, as shown by the arrow in FIG. 5. The ribs 30 are shown only schematically in FIG. 2 with no spiral configuration and with the teeth 32 being omitted for simplification. As shown in FIG. 4, however, the ribs 30 are somewhat curved in transverse section with their trailing edges 36 nearer their axis of rotation than their leading edges 38.

In operation, the ladder 10 is lowered to urge the head 22 against the marine bottom, the shaft 20 is driven by the motor 26 and the dredge pump is driven by a prime mover (not shown) on the dredge hull to suck water and solids, i.e., cutter rubble or debris, through the mouth 16 of the suction pipe 12 for conveyance through a discharge line (not shown) to any desired location.

When the cutter head 22 is operating in sand or muck, the solids or cutter debris are no problem. On the other hand, when the cutter head 22 is operating in hard lumpy clay, sandstone, coral or other fossil or rock formations, large hard lumps of cuttings or rubble are produced which pass between the ribs 30 of the cutter head 22 and into the mouth 16 of the suction pipe 12. Such large hard lumps are apt not only to clog the suction pipe 12 but also to clog or damage the dredge pump. Moreover, such lumps may damage the suction pipe 12 and also damage or clog the discharge line if they pass undiminished in size through the dredge pump. In any event, the passage of such large hard lumps into the suction pipe 12 is not to be desired, and this invention provides means for crushing such large hard lumps into smaller non-damaging and non-clogging pieces before passage into the suction pipe.

For this purpose, there is provided within the cutter head 22 a crusher 40 of open-work construction secured at its rearward end, as by welding, to the plate 14. The forward end of the crusher 40 may be of planar circular plate-like construction, as at 42, having a central aperture 44 receiving the sleeve 34. Extending rearwardly from the periphery of the plate 42 is a crusher grid of frusto-conical construction having interconnected longitudinal and cicumferential strong sturdy steel bars 46 and 48, respectively, having openings therebetween. The rear end of the crusher 40 is formed by a ring member 50 that is secured, as by welding, to the plate 14. The openings in the crusher grid are sized to pass lumps or chunks of hard material of only a predetermined maximum size. For example, it has been found that lumps of 4" maximum cross-sectional dimension will pass readily through the pump and lines of a 14" dredge, i.e., having a 14" pump and 14" lines. Hence, for a 14" dredge, the openings should be no larger than 4" maximum dimension.

Figure 3:
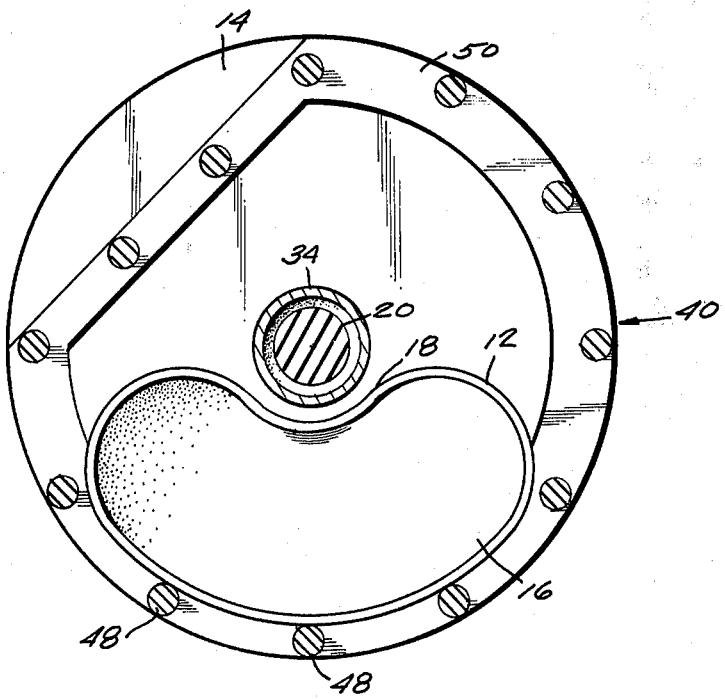
FIG. 3 is a sectional view taken on line 3—3 of FIG. 2.

In transverse section, as shown in FIGS. 3 and 4, the crusher 40 is substantially circular or annular throughout appropriately at least a 180° sector, preferably a 270° sector, but is substantially flat, i.e., chordal, throughout the remaining 180°, or preferably 90°, sector. In front view, for a cutter head which rotates clockwise, the less than 180° chordal sector of the crusher is in the northwest quadrant, as shown in FIGS. 3 and 4. For a counterclockwise rotating head, the less than 180° chordal sector would be in the northeast quadrant. The radial spacing between the circular sector of the crusher 40 and the inner or trailing edges 36 of the ribs 30 is desirably maintained substantially constant and for a 14" dredge is restricted to, for example, no more than about 5 inches, i.e., a little larger than the maximum dimension of the grid openings. For this purpose, the ribs 30 are built up, on their inner sides, with thick strong steel plates 52, 54 secured to the ribs and to each other as by welding. One plate 52 rectangular in transverse section, as shown in FIG. 4, inclines radially inwardly rearwardly of its leading edge, which is set back from the leading edge 38 of the rib 30. At its trailing edge, the plate 52 is secured to the plate 54 which extends radially inwardly from the trailing edge 36 of the rib 30, somewhat beyond the plate 52, and terminates in a bulbous abrasion-resistant edge 56. It is the radial distance between this edge 56 and the crusher 40 which is restricted as described above. Preferably, the plates 52, 54 are reinforced by a number of gusset plates 58 positioned normal to the ribs 30 and the plates 52, 54, in the space encompassed thereby, and welded thereto.

In operation the ladder 10 is lowered or inclined downwardly until the cutter head 22 engages and digs into the marine bottom. As the ribs 30 and teeth 32 dig, grab, and break the material of the marine bottom, should large hard lumps be produced they normally will pass between the ribs 30 into the cutter head 22 at the lower part thereof, i.e. the southeast and southwest quadrants. Any lumps too large to be sucked and passed through the openings in the crusher grid 46, 48 are trapped between the crusher grid and the ribs 30 and carried and driven by the latter clockwise, as viewed in FIGS. 3 and 4. The spiral configuration of the ribs 30 produces a shearing and crushing action on large lumps engaged against the lontitudinal and circumferential bars 46, 48 of the crusher grid. If not sufficiently reduced in size by such action, when such over-size lumps reach the northwest quadrant, they tumble into the area between the ribs 30 and the chordal sector of the crusher 40. There the lumps are crushed further by the cam-wedge action between the plates 52, 54 on the ribs 30 and the chordal sector of the crusher 40. Any oversize lumps which might survive this action will be shattered by the wedge-like crushing action of the bulbous edge 56 of the plate 54 against the chordal sector of the crusher 40. Once such over-size lumps are so crushed, the fragments pass readily through the open spaces in the crusher grid 46, 48 and thence into the suction pipe 12.

The construction of the crusher 40 is such that it can be installed in a conventional cutter head with only minor modifications to the head, i.e. the build up of the plates 52, 54 on the inner side of the ribs 30. In actual practice, it has been found that the combination of the crusher 40 with the cutter head 22 greatly reduces vibration on the dredge and in the dredge pumping system, apparently by minimizing or eliminating the passage therethrough of large lumps of hard material. It further has been found that the crusher 40 increases the percentage of pumpable solids, thus increasing production. Even further, the crusher 40 reduces down time for cleaning clogged lines and repairing the dredge pump with resultingly increased operating time and efficiency.

It thus will be seen that the objects and advantages of this invention have been fully and effectively achieved. It will be realized, however, that the foregoing specific embodiment has been disclosed only for the purpose of illustrating the principles of this invention and is susceptible of modification without departing from such principles. Accordingly, the invention includes all embodiments encompassed within the spirit and scope of the following claims.

What is claimed is:

1. In a suction dredge having a ladder carrying a suction pipe and a driven cutter head of open-work divergently spiral toothed-rib construction which encloses and is rotatable about the mouth of the pipe, the combination of:

a crusher of open-work construction fixed relative to and enclosing the mouth within and cooperating with the cutter head on rotation thereof to crush therebetween large lumps passing through the cutter head to minimize damage and clogging of suction and discharge lines and the dredge pump, said crusher being of generally frusto-conical configuration and generally-coaxial with the head and being provided with interconnecting generally-circumferential and generally-longitudinal bars defining openings therebetween, whereby the head ribs sweep large lumps dug by the head into the clearance between the ribs and bars so as to exert a crushing action which breaks the lumps into smaller pieces which can pass through said openings and into the mouth of the pipe.

2. The structure defined in claim 1 wherein the maximum dimension of the openings in the crusher is less than the maximum circumferential dimension of the openings in the cutter head.

3. The structure defined in claim 1 wherein the radial spacing between the cutter head and the crusher is substantially constant and somewhat greater than the maximum dimension of the openings in the crusher.

4. The structure defined in claim 1 wherein each rib of the cutter head has an inner surface portion that inclines radially inwardly from the leading to trailing edge thereof, such surfaces effecting with the crusher a wedging crushing action on lumps therebetween.

5. The structure defined in claim 4 in which the trailing edge of the surface portion terminates in a radially inwardly extenting wear-resistant rib-like bulbous projection.

6. In a suction dredge having a ladder carrying a suction pipe and a driven cutter head of open-work divergently spiral toothed-rib construction which encloses and is rotatable about the mouth of the pipe and in operation is inclined downward and forward into the marine bottom, the combination of:

a crusher of open-work construction fixed relative to and enclosing the mouth within and cooperating with the cutter head on rotation thereof to crush therebetween large lumps passing through the cutter head to minimize damage and clogging of suction and discharge lines and the dredge pump, said crusher being of generally frusto-conical configuration and generally-coaxial with the head and being provided with interconnecting generally-circumferential and generally-longitudinal bars defining openings therebetween, a sector of said crusher of not more than about 180° being of flat chordal configuration and located substantially within the upper half of the cutter head, whereby the head ribs sweep large lumps dug by the head into the clearance between the ribs and bars so as to exert a crushing action which breaks the lumps into smaller pieces which can pass through said openings and into the mouth of the pipe.

7. The structure defined in claim 6 wherein the sector is less than 180° and is located within that portion of the upper half of the cutter head first approached by the ribs during their rotation.

8. The structure defined in claim 6 wherein each rib of the cutter head has an inner surface portion that inclines radially inwardly from the leading to trailing edge thereof, such surface effecting with the crusher a wedging crushing action on lumps therebetween.

* * * * *